United States Patent [19]

Ruhland

[11] Patent Number: 4,619,517

[45] Date of Patent: Oct. 28, 1986

[54] DEVELOPMENT APPARATUS

[75] Inventor: John G. Ruhland, Rochester, N.Y.

[73] Assignee: Xerox Corporation, Stamford, Conn.

[21] Appl. No.: 713,976

[22] Filed: Mar. 20, 1985

[51] Int. Cl.[4] ..... G03G 15/08

[52] U.S. Cl. ..... 355/3 DD; 118/656; 118/661

[58] Field of Search ..... 355/3 R, 3 DD, 14 D; 118/652, 656, 657, 658, 661

[56] References Cited

U.S. PATENT DOCUMENTS 4,383,497 5/1983 Tajima ..... 355/3 DD X
4,410,259 10/1983 Yamagata et al. ..... 355/3 DD
4,459,009 7/1984 Hays et al. ..... 355/3 DD

*Primary Examiner*—Fred L. Braun
*Attorney, Agent, or Firm*—H. Fleischer; J. E. Beck; R. Zibelli

[57] ABSTRACT

An apparatus in which a latent image is developed with marking particles. The marking particles are transported to the latent image. As the marking particles are being moved to the latent image, they are electrically charged. A supply of marking particles is stored and dispensed onto the particle transport. Wrongly charged particles returned to the particle dispenser are electrically discharged.

16 Claims, 2 Drawing Figures

DEVELOPMENT APPARATUS

Figure 1:
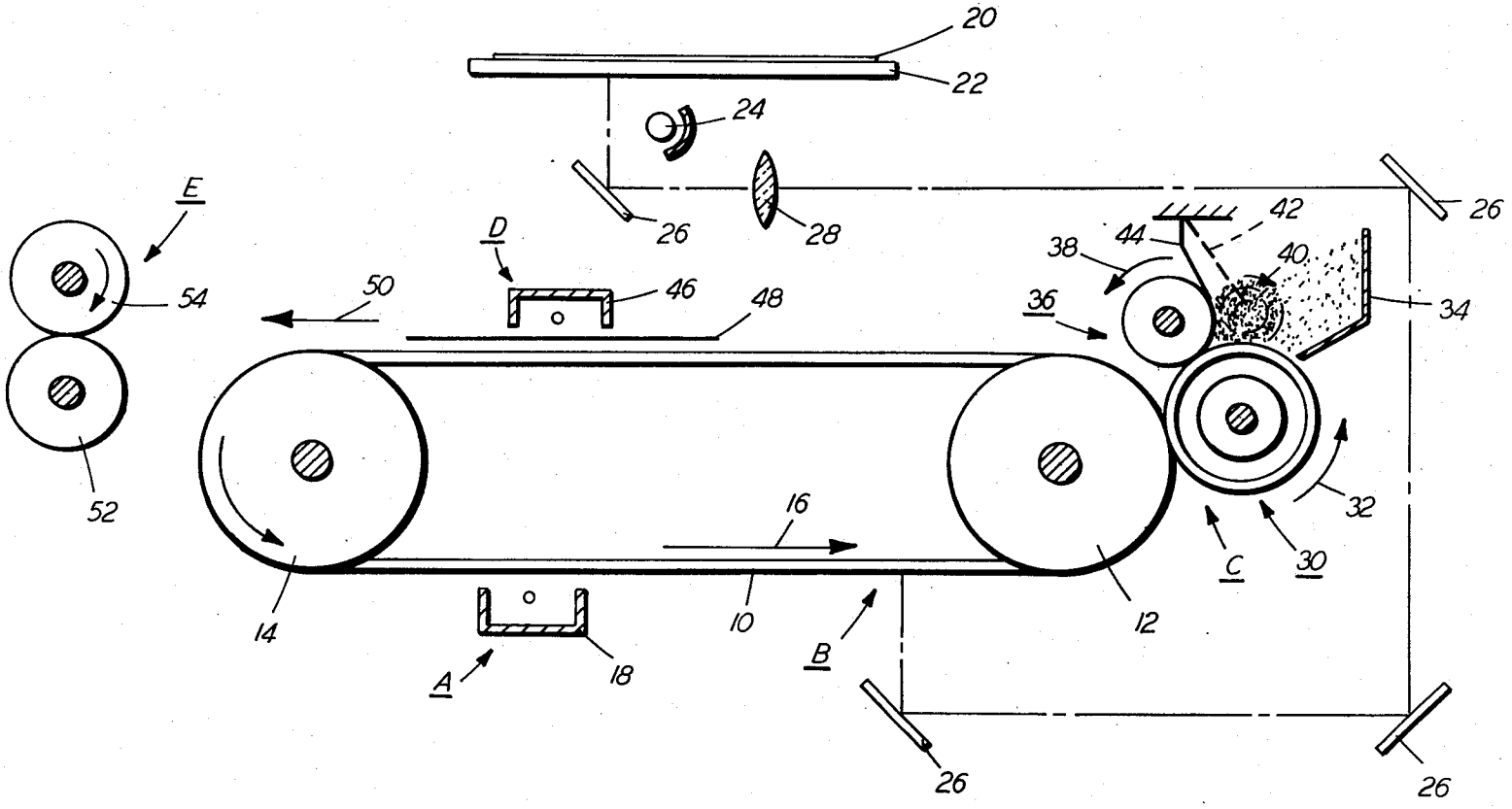

This invention relates generally to an electrophotographic printing machine, and more particularly concerns a development apparatus employed therein.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated area. This records an electrostatic latent image on the photoconductive member corresponding to the informational areas contained within the original document being reproduced. After the electrostatic latent image is recorded on the photoconductive member, the latent image is developed by bringing marking particles into contact therewith. This forms a powder image on the photoconductive member which is subsequently transferred to a copy sheet. The copy sheet is heated to permanently affix the marking particles thereto in image configuration.

Various types of development systems have hereinbefore been employed. These systems utilize two component developer material or single component developer material. Two component developer material includes toner particles adhering triboelectrically to carrier granules. Alternatively, the single component development system utilizes only toner particles. In many of the single component development systems, the toner particles are conductive. However, the transfer of conductive toner particles to the copy sheet is usually inefficient. In order to overcome this problem, insulating toner particles are frequently employed. These toner particles have been found to produce high quality copies. A variety of development systems have been used to deposit insulating toner particles onto the electrostatic latent image. The following disclosures appear to be relevant:

U.S. Pat. No. 4,459,009, Patentee: Hays et al., Issued: July 10, 1984.

Co-Pending U.S. application Ser. No. 549,096, now U.S. Pat. No. 4,556,013, Applicant: Gundlach et al., Filed: Nov. 7, 1983.

The relevant portions of the foregoing disclosures may be briefly summarized as follows:

Hays et al. described a development system having a donor roller which contacts a photoconductive surface to develop a latent image with insulating toner particles. A charging roller transports the toner particles to the donor roller and imparts a charge thereon. The charging roller has a triboelectrically active coating thereon so that in the contact zone between the charging roller and donor roller a charge is induced on the toner. A doctor blade regulates the amount of toner particles on the charging roller and aids in inducing the charge thereon.

Gundlach et al. describes a development system having a donor roller mounted adjacent a toner housing containing a supply of toner particles therein. A screen is interposed between the toner housing and the donor roller. As the toner particles pass through the screen and are metered onto the donor roller, the toner particles are frictionally charged. The charged toner particles adhere to the donor roller which advances the toner into contact with the latent image recorded the photoconductive surface. Toner is deposited on the latent image to form a powder image on the photoconductive surface.

Pursuant to the features of the present invention, there is provided an apparatus for developing a latent image with marking particles. The apparatus includes means for transporting the marking particles to the latent image. Means are provided for electrically charging the marking particles being moved to the latent image by the transporting means. Means store a supply of marking particles and dispense the marking particles to the transporting means. Means electrically discharge the wrongly charged marking particles returned to the storing means.

In accordance with another aspect of the present invention, there is provided an electrophotographic printing machine of the type having an electrostatic latent image recorded on a photoconductive member. The latent image is developed with insulating toner particles to form a toner powder image thereon. The toner powder image is transferred to a copy sheet and subsequently permanently fused thereto. The improved printing machine includes means for transporting the toner particles to the electrostatic latent image recorded on the photoconductive member. Means are provided for electrically charging the toner particles being moved to the electrostatic latent image recorded on the photoconductive member by the transporting means. Means store a supply of toner particles and dispense the toner particles to the transporting means. Means electrically discharge the wrongly charged toner returned to the storing means.

Figure 2:
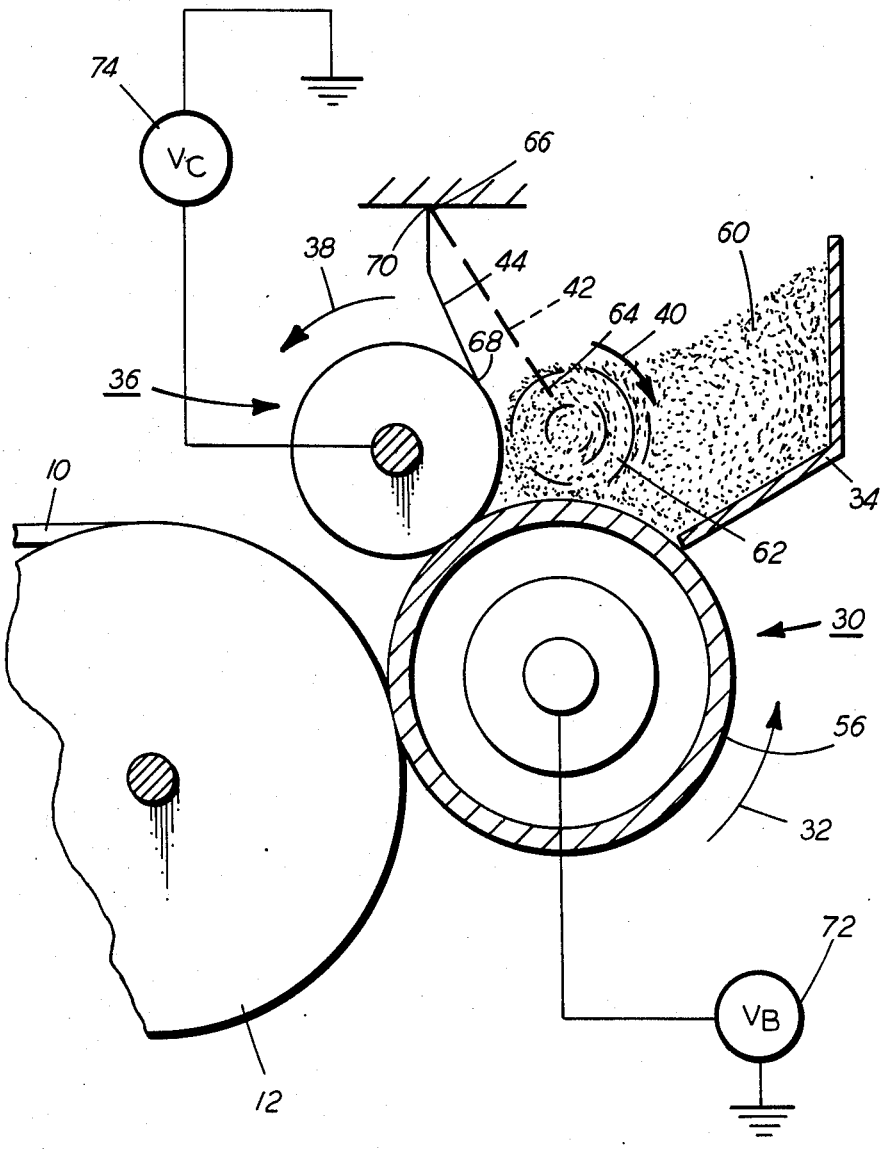

Other aspects of the present invention will become apparent as the following description proceeds and upon reference to the drawings, in which:

FIG. 1 is a schematic elevational view depicting an electrophotographic printing machine incorporating the development apparatus of the present invention therein; and FIG. 2 is a schematic elevational view showing the development apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used to identify identical elements. FIG. 1 schematically depicts the various components of an illustrative electrophotographic printing machine having the development apparatus of the present invention therein. It will become evident from the following discussion that the development apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface deposited on a conductive substrate. Preferably, the photoconductive surface is made from a selenium alloy with the conductive substrate being made from an aluminum alloy. Other suitable photoconductive materials and conductive substrates may also be employed. Belt 10 is entrained about a pair of opposed spaced rollers 12 and 14. Roller 14 is rotated by a motor coupled thereto by suitable means, such as a drive belt. As roller 14 rotates, belt 10 advances the photoconductive surface, in the direction of arrow 16, through the various processing stations disposed about the path of movement thereof.

Initially, the photoconductive surface passes through charging station A. At charging A, a corona generating device 18 charges the photoconductive surface to a relatively high substantially uniform potential.

Next, the charged portion of the photoconductive surface is advanced through imaging station B. At image station B, an original document 20 is positioned face down upon a transparent platen 22. Imaging of document 20 on platen 22 is achieved by an exposure system which includes a lamp 24, mirrors 26, and a moving lens 28. The exposure system is a moving optical system wherein the lamps, mirrors, and lens move across the original document illuminating incremental widths thereof. In this way an incremental width light image is formed. The light image is projected onto the charged portion of the photoconductive surface. The charged photoconductive surface is selectively discharged by the light image to record an electrostatic latent image of the original document thereon. Thereafter, belt 10 advances the electrostatic latent image recorded on the photoconductive surface to development station C.

At development station C, a donor roller, indicated generally by the reference numeral 30, transports weakly charged, insulating, non-magnetic toner particles into contact with the electrostatic latent image recorded on the photoconductive surface of belt 10. Donor roller 30 rotates in the direction of arrow 32. A toner particle supply reservoir 34 furnishes toner particles to donor roller 30. Metering charging roller, indicated generally by the reference numeral 36, contacts donor roller 30 to define a nip therebetween. Metering charging roller 36 rotates in the direction of arrow 38. The weakly charged toner particles on donor roll 30 pass through the nip between metering charging roller 36 and donor roller 30. As a result of the movement in opposite directions of metering charging roller 36 and donor roller 30, the toner particles in the nip acquire a charge thereon. These charged toner particles are then transported by the compliant donor roller 30 to the electrostatic latent image recorded on the photoconductive surface. The electrostatic latent image attracts the toner particles from donor roller 30 to form a powder image on the photoconductive surface of belt 10. It has been found that in the region of the nip between donor roller 30 and charging roller 36, wrongly charged toner particles rotate in the direction of arrow 40. This rotation is due to the rotation of donor roller 30 and charging roller 36. As these wrongly charged toner particles rotate, they acquire a high charge in this region. In order to insure that the toner particles advancing into the nip between charging roller 36 and donor roll 30 are weakly charged, screen 42 has the free end thereof immersed in this whirling mass of toner particles. The other end of screen 42 is electrically grounded. In this way, the whirling mass of toner particles is electrically discharged prior to entering the nip defined by charging roller 36 and donor roller 30. A doctor blade 44 has the free end thereof contacting charging roller 36, doctor blade 44 acts as a seal to prevent to the toner particles from advancing therebeyond on charging roller 36. It has been found that the wrongly charged toner particles removed from charging roller 36 by doctor blade 44 contribute to the charge of the whirling mass of toner particles. Further details of the development system will be described hereinafter with reference to FIG. 2.

With continued reference to FIG. 1, belt 10 then advances the toner powder image to transfer station D. At transfer station D, a corona generating device 46 sprays ions onto the backside of copy sheet 48 positioned thereat. This attracts the toner powder image from the photoconductive surface of belt 10 to copy sheet 48. After transfer of the toner powder image to copy sheet 48, copy sheet 48 advances, in the direction of arrow 50, through fusing station E.

Fusing station E includes a heated fuser roller 52 and a back-up roller 54 with the toner powder image on copy sheet 48 contacting fuser roller 52. In this manner, the powder image is permanently affixed to copy sheet 48. After fusing, the copy sheet is advanced by forwarding rollers through chutes to a catch tray where the operator removes the completed copy.

Referring now to FIG. 2, the detailed structure of the development apparatus is shown thereat. The development apparatus includes a compliant donor roller 30. Donor roller 30 has a fluoropolymer coating 56 thereon. Coating 56 covers the entire external circumferential surface thereof. Generally, coating 56 has a thickness ranging from about 2 micrometers to about 125 micrometers and preferably ranges from about 10 micrometers to about 50 micrometers. Donor roller 30 may be made from any suitable material including, for example, aluminized milar, overcoated with a fluoropolymer coating 56, a seamless extruded polymer sleeve overcoated with a polymer containing a conductive additive such as carbon black, which sleeves are overcoated with a fluoropolymer, or a bare electroformed nickel sleeve, containing thereover a fluoropolymer coating processed in such a manner as to impart a texture to the surface thereof. Charging roller 36 is a metal roller which may be solid or hollow and may include numerous known suitable materials including, for example, aluminum, steel, iron, polymer materials, and the like, provided there are sufficient strength to be operable in the system. Generally, the roller 36 is preferably made from aluminum. Toner supply reservoir 34 has a supply of toner particles 60 therein. The supply of toner particles 60 in reservoir 34 are weakly charged positive and weakly charged negative particles. A cylindrical churning mass of toner particles 62 forms in reservoir 34 attached to and driven by both donor roller 30 and charging roller 36 to rotate in the direction of arrow 40. It has been found that this churning cylindrical toner mass 62 rotating in the direction of arrow 40 acquires a large negative surface potential, typically several thousand volts. A screen 42 has the free end region thereof 64 immersed in rotating toner particle mass 62. The other end 66 of screen 42 is mounted fixably and electrically grounded. In this way, screen 42 electrically discharges the rotating toner particle mass 62. Preferably, screen 42 is made from copper with eight substantially equally spaced apertures per centimeter. It has been found that toner discharge screen 42 reduces the diameter of the rotating toner particle mass 62 and discharges the highly negative surface potential thereof. Doctor blade 44 has the free end 68 thereof contacting the surface of charging roller 36. In this way, as charging roller 36 rotates in the direction of arrow 38, toner particles are cleaned therefrom by doctor blade 44. The other end 70 of doctor blade 44 is mounted fixedly. The wrongly charged toner particles removed from metering roller 36 contribute to the charge of the churning mass of toner particles 62. Donor roller 30 is electrically biased by voltage source 72. For a positive charging system, voltage source 72 applies a voltage $V_B$ generally ranging from about +75 volts to about +450 volts or from about −75 volts to about −450 volts thereon. Voltage source 74 electrically biases charging roller 76 to a voltage $V_c$ which ranges from about +25 volts to about +200 volts. The detailed structure of the development apparatus, exclusive of discharging screen 42 and rotating toner particle mass 62, is described more fully in U.S. Pat. No. 4,459,009 issued in 1984 to Hays et al., the relevant portions thereof being hereby incorporated into the present application.

In recapitulation, the weakly charged insulating toner particles form a rotating toner particle mass which is electrically discharged by a toner particle screen. Toner particles are deposited on a compliant donor roll. The toner particles are moved into rubbing contact with the metering and charging roller which induces a charge thereon. The polarity of the charge is selected such that the toner particles will be attracted to the electrostatic latent image recorded on the photoconductive surface.

It is, therefore, evident that there has been provided in accordance with the present invention, a development apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as which fall within the spirit and broad scope of the appended claims.

I claim:

1. An apparatus for developing a latent image with marking particles, including:

means for transporting the marking particles to the latent image;

means for electrically charging the marking particles being moved to the latent image by said transporting means;

means for storing a supply of marking particles and dispensing marking particles to said transporting means; and means, spaced from said charging means, for electrically discharging the wrongly charged marking particles returned to said storing means.

2. An apparatus according to claim 1, wherein said charging means meters the quantity of marking particles being moved by said transporting means to the latent image.

3. An apparatus according to claim 2, wherein said charging means includes a charging roller.

4. An apparatus according to claim 3, wherein said transporting means includes a donor roller positioned in contact with said charging roller to define a nip therebetween with the marking particles being charged in the nip.

5. An apparatus according to claim 4, wherein said discharging means includes a screen having the free end thereof immersed in the marking particles in the region of the nip with the other end of said screen being electrically grounded.

6. An apparatus according to claim 5, wherein said screen has about 8 apertures per centimeter.

7. An apparatus according to claim 6, wherein said screen is made from copper.

8. An apparatus according to claim 5, further including:

means for electrically biasing said donor roller to a preselected voltage level; and means for electrically biasing said charging roller to a preselected voltage level.

9. An electrophotographic printing machine of the type having an electrostatic latent image recorded on a photoconductive member with the latent image being developed with insulating toner particles to form a toner powder image thereon that is transferred to a copy sheet and substantially permanently fused thereto, wherein the improvement includes:

means for transporting the toner particles to the electrostatic latent image recorded on the photoconductive member;

means for electrically charging the toner particles being moved to the electrostatic latent image recorded on the photoconductive member by said transporting means;

means for storing a supply of toner particles and dispensing toner particles to said transporting means; and means, spaced from said charging means, for electrically discharging the wrongly charged toner particles returned to said storing means.

10. A printing machine according to claim 9, wherein said charging means meters the quantity of toner particles being moved by said transporting means to the electrostatic latent image recorded on the photoconductive member.

11. A printing machine according to claim 10, wherein said charging means includes a charging roller.

12. A printing machine according to claim 11, wherein said transporting means includes a donor roller positioned in contact with said charging roller to define a nip therebetween with the toner particles being charged in the nip.

13. A printing machine according to claim 12, wherein said discharging means includes a screen having the free end thereof immersed in the toner particles in the region of the nip with the other end of said screen being electrically grounded.

14. A printing machine according to claim 13, wherein said screen has about 8 apertures per centimeter.

15. A printing machine according to claim 14, wherein said screen is made from copper.

16. A printing machine according to claim 13, further including:

means for electrically biasing said donor roller to a preselected voltage level; and means for electrically biasing said charging roller to a preselected voltage level.

* * * * *